US007726377B2

(12) United States Patent
Okachi

(10) Patent No.: US 7,726,377 B2
(45) Date of Patent: Jun. 1, 2010

(54) SCREEN DEVICE

(75) Inventor: Yasubumi Okachi, Kanagawa (JP)

(73) Assignee: Metaco Inc., Minato-Ku, Tokyo (JP)

( * ) Notice: Subject to any disclaimer, the term of this patent is extended or adjusted under 35 U.S.C. 154(b) by 0 days.

(21) Appl. No.: 11/661,634

(22) PCT Filed: Aug. 31, 2005

(86) PCT No.: PCT/JP2005/016354

§ 371 (c)(1),
(2), (4) Date: Aug. 2, 2007

(87) PCT Pub. No.: WO2006/025582

PCT Pub. Date: Mar. 9, 2006

(65) Prior Publication Data

US 2008/0066875 A1 Mar. 20, 2008

(30) Foreign Application Priority Data

Sep. 3, 2004 (JP) ..... 2004-257669

(51) Int. Cl.
*E06B 3/94* (2006.01)

(52) U.S. Cl. ..... 160/84.06; 160/84.03

(58) Field of Classification Search ..... 160/84.06, 160/84.03, 84.04, 273.1, 199, 206
See application file for complete search history.

(56) References Cited

U.S. PATENT DOCUMENTS 4,733,711 A * 3/1988 Schon ..... 160/84.03
4,799,524 A * 1/1989 Guermonprez ..... 160/84.03
4,862,941 A * 9/1989 Colson ..... 160/84.02
4,979,551 A * 12/1990 Schon ..... 160/84.03
5,219,015 A * 6/1993 Kraeutler ..... 160/271
5,351,737 A * 10/1994 Hoshiyama ..... 160/84.03
5,377,737 A * 1/1995 Moriya et al. ..... 160/84.06
5,456,303 A * 10/1995 Horinouchi ..... 160/84.04

(Continued)

FOREIGN PATENT DOCUMENTS

JP 5-295970 11/1993

(Continued)

OTHER PUBLICATIONS

Microfilm of the specification and drawings annexed to the request of Japanese Utility Model Application No. 75022/1981 (Laid-open No. 187396/1982) (Seiki Juko Kabushiki Kaisha), Nov. 27, 1982, p. 5, lines 2 to 11; Figs. 1, 3.

*Primary Examiner*—David Purol
(74) *Attorney, Agent, or Firm*—Wenderoth, Lind & Ponack, L.L.P.

(57) ABSTRACT

A screen device in which a screen is provided in a contractable and expandable manner between a pair of screen installation frames, at least one of which is movable in a sliding manner, and the screen can be opened and closed by pulling it sideways, and which has upper guide frames for guiding the screen installation frames while covering their upper end sections. The screen installation frames have, at their upper end sections, fall-down prevention guide sections. The upper guide frames have, in their insides, guide rail projections which prevent, by holding the fall-down prevention guide sections, the upper end sections of the screen installation frames from coming out of the upper guide frames.

10 Claims, 18 Drawing Sheets

U.S. PATENT DOCUMENTS 5,477,904 A * 12/1995 Yang ..... 160/370.23
5,873,401 A * 2/1999 Tsuchida ..... 160/84.04
5,979,533 A * 11/1999 Dupuie ..... 160/84.06
6,186,212 B1 * 2/2001 Tsuchida ..... 160/84.06
6,318,438 B1 * 11/2001 Uno et al. ..... 160/31
6,533,017 B1 * 3/2003 Toti ..... 160/168.1 V
6,715,531 B2 * 4/2004 Simon ..... 160/271
6,766,847 B1 * 7/2004 Wang ..... 160/199
6,978,820 B2 * 12/2005 Aoki ..... 160/84.06

FOREIGN PATENT DOCUMENTS

JP 10-306646 11/1998
JP 2000-136666 5/2000
JP 2001-340209 12/2001
JP 2002-70429 3/2002
JP 2002-242563 8/2002
JP 2003-148066 5/2003

* cited by examiner

SCREEN DEVICE

BACKGROUND OF THE INVENTION

1. Field of the Invention

The present invention relates to a screen device which is useful as a curtain, a blind, a screen, a partition and the like.

2. Description of the Related Art

As shielding or light control means such as a curtain and a blind, or as a screen or a partition, a screen device provided with various kinds of mechanisms has been conventionally developed, and has been put into practical use.

As such a screen device, the present applicant has developed a novel screen device, in which cloth, a sheet, or a net is freely folded and unfolded by pleating.

In the device, a screen 2 is interposed between a pair of screen installation frames 1 and 1, at least one of which can slide, in such a manner as to be contractable and expandable by pleating, and further, the screen 2 can be opened and closed by a sliding motion of the screen installation frame 1, as shown in, for example, FIG. 16. In the device, the independence of the screen 2 can be maintained by a wire stretched across the screen installation frames 1 and 1.

The screen device includes an upper guide frame 3 serving as a member for guiding the sliding motion of the screen installation frame 1, and further, the upper guide frame 3 covers the upper end section of the screen installation frame 1.

Additionally, the present applicant has developed and put into practical use a screen device, in which a screen can be more smoothly opened or closed with stability.

As shown in FIGS. 17 and 18, in the device, the upper guide frame 3 covers the upper end section of the screen installation frame 1, so as to guide the sliding motion of the screen installation frame 1. In the meantime, a slide guide frame 5 is additionally provided. The slide guide frame 5 is fixed at one end thereof to either one of the screen installation frames 1, and further, is bent at the other end thereof to be freely inserted into the other screen installation frame 1. The slide guide frame 5 may be constituted of a so-called caterpillar, in which rigid units 6, each having, for example, a side wall 6*a* and a bridge 6*b*, are disposed continuously to each other. The lower slide guide frame 5 can slide along a rail 7. The slide guide frame 5 formed by continuously disposing the rigid units 6 has bendability and rigidity, thereby smoothly opening and closing the screen 2 with stability.

SUMMARY OF THE INVENTION

The screen device developed by the present applicant is innovative in that the screen, which is contractable and expandable by the pleating, can be smoothly opened and closed with stability. Furthermore, characteristics of the screen device have become more prominent, and further, problems to be solved for further enhancing the stability and workability of the device have been revealed in the process of examining technical improvements thereafter studied by the present applicant.

For example, although the upper guide frame 3 covers the upper end section of the screen installation frame 1 in the conventional screen device, there may occur an inconvenience that the screen installation frame 1 accidentally falls down since the screen installation frame 1 is inclined and the upper end section of the screen installation frame 1 is detached from the upper guide frame 3 in the case where a large external force is exerted on the screen 2 or the screen installation frame 1 due to strong winds or a contact with a human body, as is obvious from FIG. 18.

In addition, when the screen installation frame 1 is repaired or a new screen installation frame 1 is disposed in a position after the inclination or falling-down, it is not always easy to insert the upper end section of the screen installation frame 1 into the upper guide frame 3 due to weight and size as the screen device is further increased in size.

In view of this, the invention has been developed to solve the problems experienced in the prior art. Therefore, an object of the invention is to provide a novel screen device, in which an upper end section of a screen installation frame can be prevented from falling down from an upper guide frame, and further, the upper end section of the screen installation frame is readily inserted into the upper guide frame even in a large-sized screen device.

In order to solve the problems, a screen device according to the invention has following characteristics:

(1) In a screen device, in which a screen is interposed between a pair of screen installation frames, at least one of which can slide, in such a manner as to be contractable and expandable, thus to be laterally opened or closed, and an upper guide frame covers an upper end section of the screen installation frame, for guiding the screen installation frame, the screen installation frame includes a fall-down prevention guide section formed of a projection or a groove at an upper end section of the screen installation frame, and the upper guide frame includes therein a guide rail projection, to which the fall-down prevention guide section is locked when the screen installation frame is inclined, so as to prevent the upper end section of the screen installation frame from being detached from the upper guide frame.

(2) At least one of a pair of suspending walls facing each other in the upper guide frame has elasticity, wherein the suspending wall having the elasticity is opened outward when the upper end section of the screen installation frame is inserted into the upper guide frame.

(3) A part of the guide rail projection is cut out, so that the upper end section of the screen installation frame can be inserted into the upper guide frame through the cutout.

(4) A part of the suspending wall of the upper guide frame is cut out, so that the upper end section of the screen installation frame can be inserted into the upper guide frame through the cutout.

(5) The upper guide frame is positioned with a clearance, so that the upper end section of the screen installation frame can be inserted into the upper guide frame through the clearance.

(6) A plurality of the upper guide frames are positioned with a clearance, and a cap member is fixed thereon.

(7) The clearance and the cap member are positioned in a mating position of separation type screen devices, and further, a stopper is positioned at the mating position inside the cap member.

(8) Both of a pair of screen installation frames, each having the screen attached thereto, can slide, and at least either one of the screen installation frames is connected to a slidable screen installation frame in another screen device via a connector.

(9) The screen is a foldable and unfoldable pleat net member.

According with the invention having characteristic (1), the fall-down prevention guide section is locked to the guide rail projection, so as to prevent the upper end section of the screen installation frame from being detached and falling down from the upper guide frame.

According with the invention having characteristics (2) to (5), the upper end section of the screen installation frame can be readily inserted into the upper guide frame even in a large-sized screen device.

According with the invention having characteristic (6), the plurality of clearances enable the insertion of the upper end section of the screen installation frame even in a large-sized screen device to be installed in a large space, and further, the cap member prevents a significant force from being exerted on the sliding motion of the screen installation frame, even with misalignment between axes of the upper guide frames, with an attendant advantage of visual unobtrusiveness.

According with the invention having characteristic (7), the stopper provided at the cap member can accurately set the mating position between the separation type screen devices, thus achieving a screen device that has a good exterior appearance while having excellent in stability.

According with the invention having characteristic (8), it is possible to achieve a screen device for a large space, which can produce the above-described effects.

According with the invention having characteristic (9), it is possible to achieve a screen, which can produce the above-described effects.

DETAILED DESCRIPTION OF THE INVENTION

Figure 1:
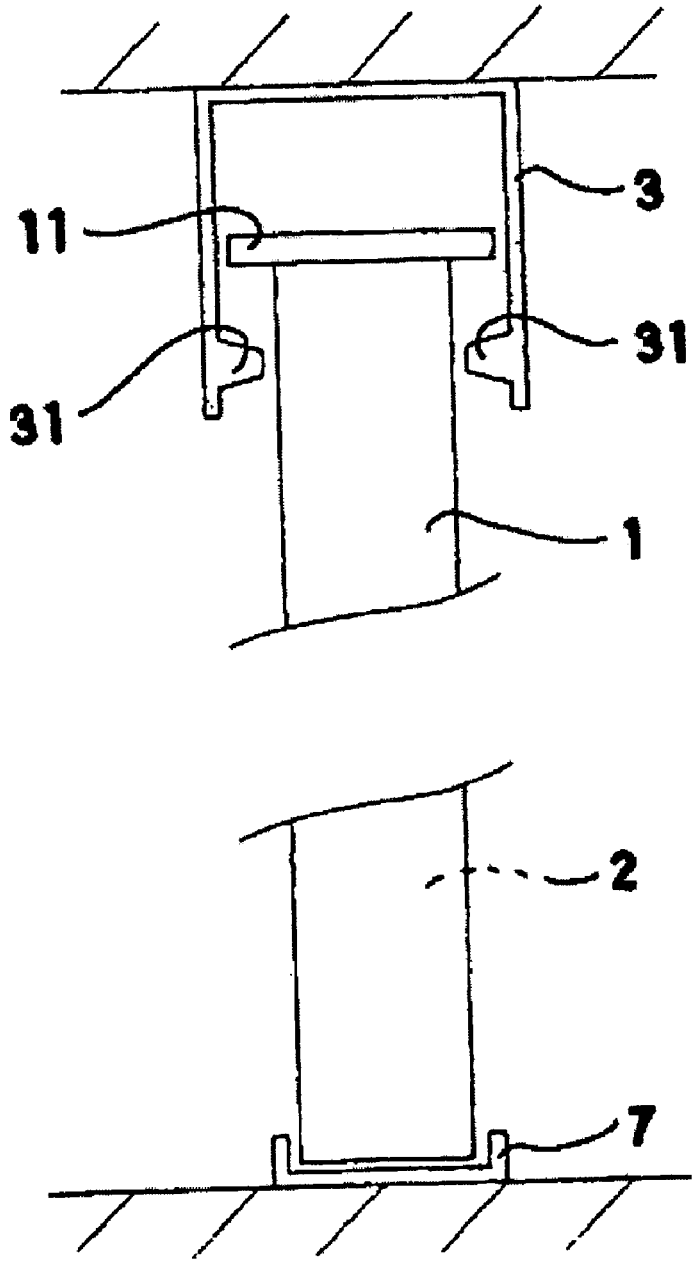
FIG. 1 is a side cross-sectional view showing the outline of a screen device according to a preferred embodiment of the invention.

In a screen device shown in FIG. 1, a screen 2 is interposed between a pair of screen installation frames 1 and 1, at least one of which can slide, in such a manner as to be contractable and expandable, and therefore, the screen 2 can be laterally opened or closed. Moreover, an upper guide frame 3 is provided to cover an upper end section of the screen installation frame 1, thereby guiding the screen installation frame 1.

In the screen device shown in FIG. 1, the screen installation frame 1 includes a fall-down prevention guide section 11 formed of a projection or a groove at the upper end section of the screen installation frame 1. The upper guide frame 3 includes therein a guide rail projection 31, which locks the fall-down prevention guide section 11 so as to prevent the upper end section of the screen installation frame 1 from being detached from the upper guide frame 3. The fall-down prevention guide section 11 may be constituted of, for example, a projection or the like having a width greater than that of the screen installation frame 1, and may be positioned at the upper end section of the screen installation frame 1.

The upper guide frame 3 can be fixed to an upper crosspiece, a ceiling face or the like of an opening of a window or a door. A lower end of the screen installation frame 1 can slide on a lower crosspiece or a floor face in a predetermined direction along a rail 7 having various kinds of shapes or structures.

Figure 2:
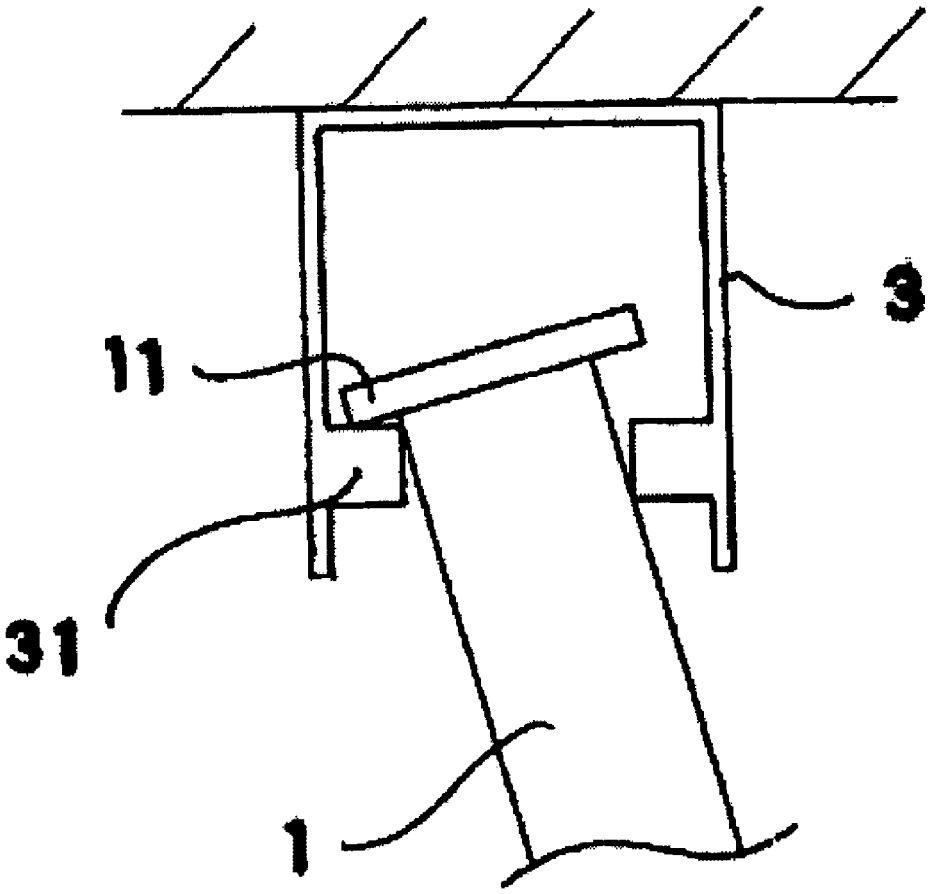
FIG. 2 is a side cross-sectional view showing essential parts for preventing a screen installation frame of the screen device shown in FIG. 1 from an upper guide frame.

Even if the screen installation frame 1 is tilted due to a large external force on the screen installation frame 1 or the screen 2 owing to strong winds or a contact with a human body, the fall-down prevention guide section 11 is locked in the guide rail projection 31, so that the screen installation frame 1 is suspended, as shown in, for example, FIG. 2, in the screen device shown in FIG. 1. Thus, the screen installation frame 1 can be prevented from being detached and falling down from the upper guide frame 3. In the state shown in FIG. 2, it is possible to correct the inclination of the screen installation frame 1, and further, to readily restore the screen device in a predetermined state.

Incidentally, the fall-down prevention guide section 11 as a molded product made of a plastic or metal can be fixed to the upper end section of the screen installation frame 1, and further, the guide rail projection 31 as a molded product made of a plastic may be integrated with the upper guide frame 3 or included via other appropriate means.

Figure 3:
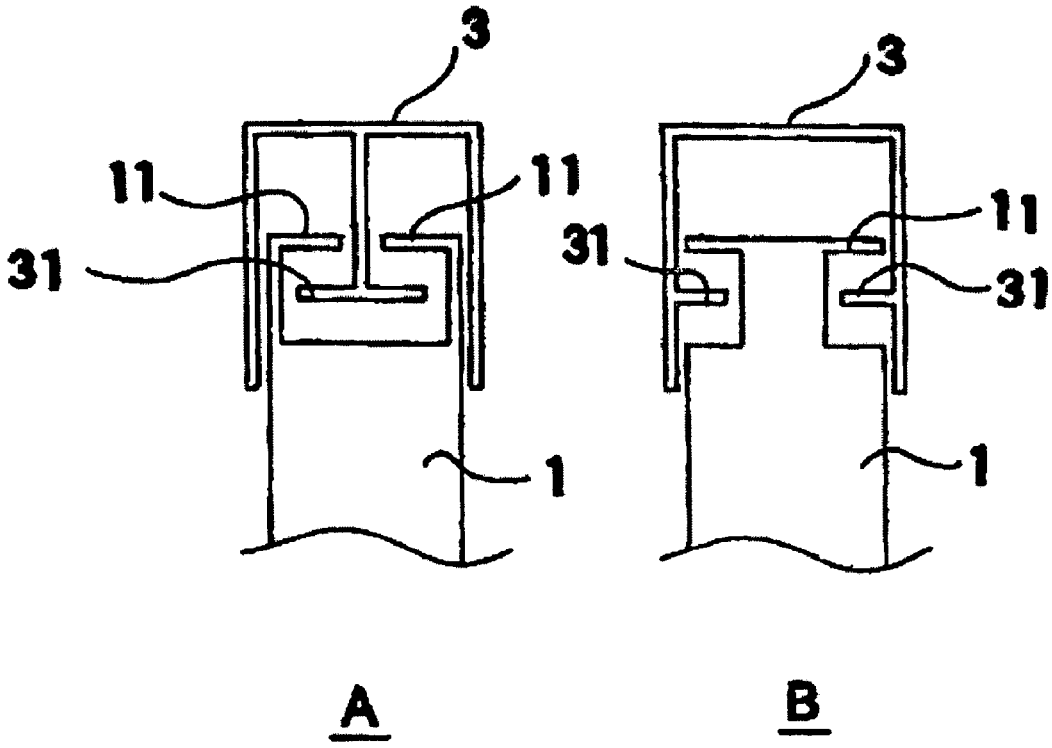
FIGS. 3A and 3B are side cross-sectional views showing essential parts explanatory of a fall-down prevention guide section and a guide rail projection in another preferred embodiment, respectively.
Figure 4:
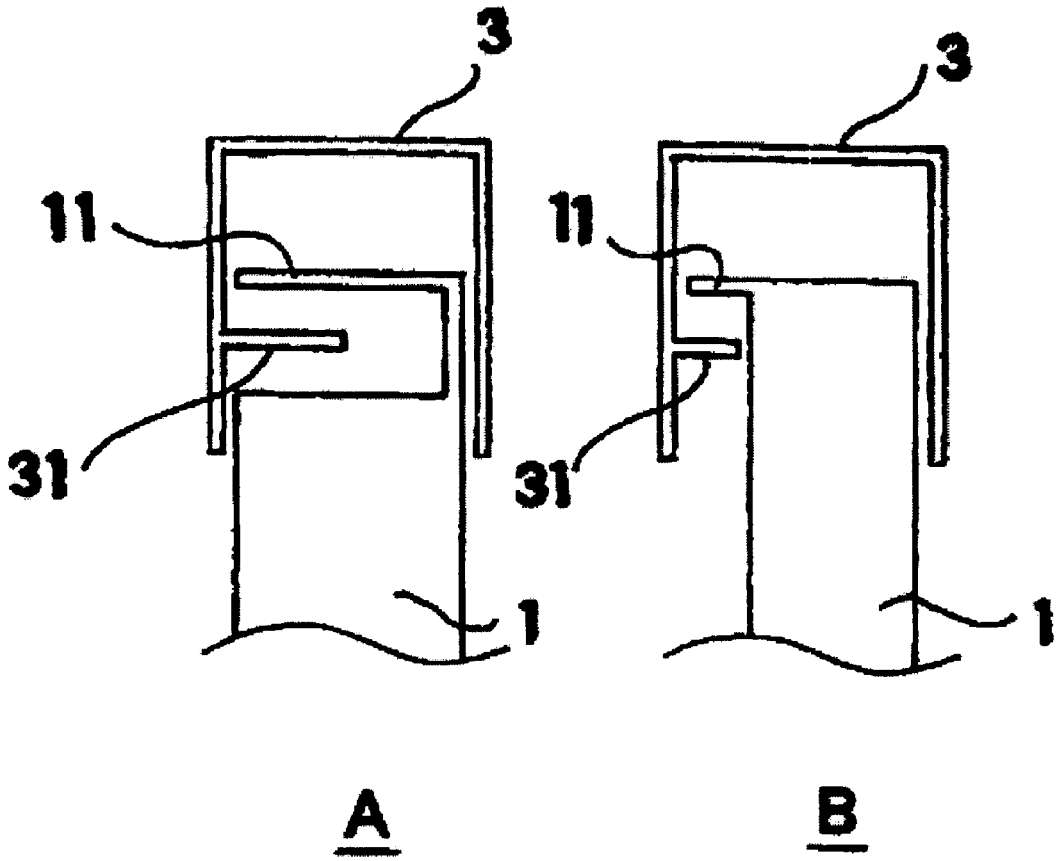
FIGS. 4A and 4B are side cross-sectional views showing essential parts explanatory of a fall-down prevention guide section and a guide rail projection in a further preferred embodiment, respectively.

The fall-down prevention guide section 11 and the guide rail projection 31 may take various shapes or arrangements. For example, as shown in FIGS. 3A and 3B, the fall-down prevention guide section 11 and the guide rail projection 31 may be formed into a laterally symmetric shape viewed in cross section. Otherwise, as shown in FIGS. 4A and 4B, the fall-down prevention guide section 11 and the guide rail projection 31 may be formed into a laterally asymmetric shape viewed in cross section. The fall-down prevention guide section 11 shown in FIG. 3A includes a channel formed into a substantial C shape viewed in cross section, and is included integrally with the upper end section of the screen installation frame 1. Inside of the upper guide frame 3 is suspended a suspending piece, to which the guide rail projection 31 is horizontally connected. The suspending piece and the guide rail projection 31 are included integrally with the upper guide frame 3. The guide rail projection 31 is housed inside of the fall-down prevention guide section 11. The fall-down prevention guide section 11 shown in FIG. 3B is formed into a substantial T shape viewed in cross section, and is included integrally with the upper end section of the screen installation frame 1. The fall-down prevention guide section 11 shown in FIG. 4A includes a groove formed into a substantial U shape viewed in cross section, and is included integrally with the upper end section of the screen installation frame 1. The guide rail projection 31 horizontally projects from the inner surface on one side of the upper guide frame 3 in such a manner as to be inserted into the U shape viewed in cross section. The fall-down prevention guide section 11 shown in FIG. 4B horizontally extends outward from one side at the upper end section of the screen installation frame 1. The guide rail projection 31 horizontally projects from the inner surface on one side of the upper guide frame 3.

The fall-down prevention guide section 11 and the guide rail projection 31, as described above, can prevent the screen installation frame 1 from being detached and falling down from the upper guide frame 3. However, it may be difficult to insert the upper end section of the screen installation frame 1 into the upper guide frame 3 when the screen device is constructed.

Figure 5:
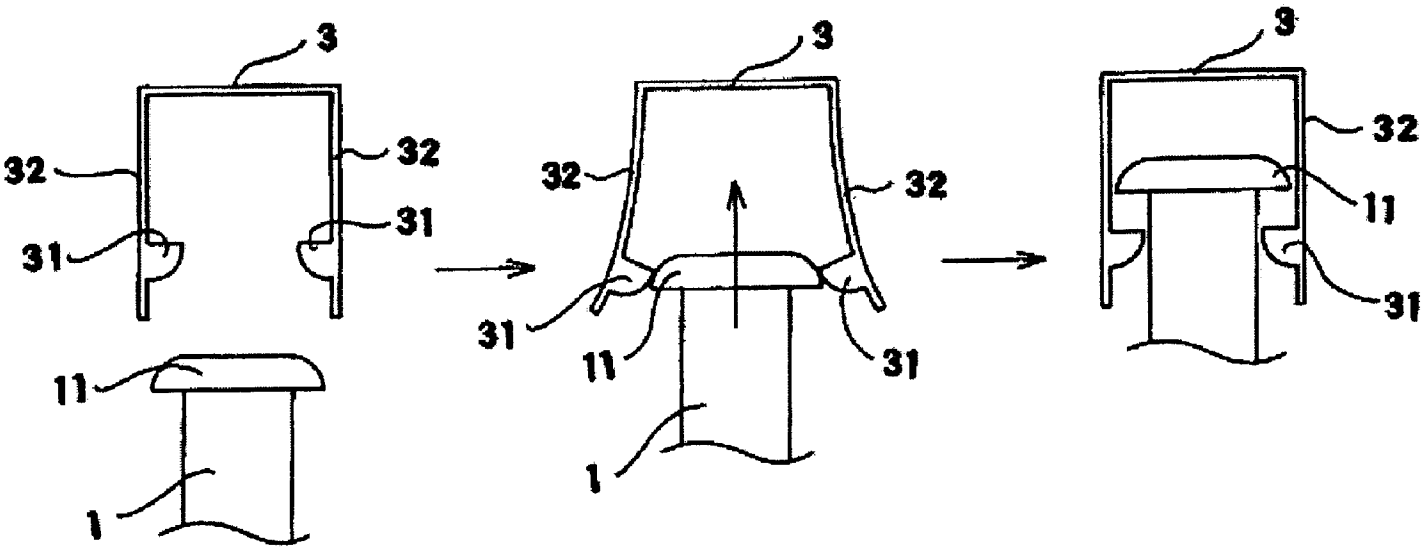
FIG. 5 is a cross-sectional view showing essential parts of the upper guide frame in one form in association with insertion of an upper end section of a screen installation frame.

In view of this, in a screen device shown in FIG. 5, at least one of a pair of suspending walls 32 facing each other in the upper guide frame 3 has elasticity, and thus, the suspending wall 32 is opened outward when the upper end section of the screen installation frame 1 is inserted into the upper guide frame 3, to be restored to its original shape owing to its elasticity after the opening.

For example, the suspending wall 32 is made of a plastic so that it is elastic. Moreover, a width between the guide rail projections 31, 31 is made smaller than the width of the fall-down prevention guide section 11. When the upper end section of the screen installation frame 1 is inserted into the upper guide frame 3, the fall-down prevention guide section 11 is pressed upward against the guide rail projections 31 at both right and left ends thereof, so that the force from the fall-down prevention guide section 11 is exerted in such a manner as to widen the suspending walls 32, thereby opening the suspending walls 32 outward with the exertion of the force, so as to enable the insertion of the screen installation frame 1. When the fall-down prevention guide section 11 rides on the guide rail projections 31, the suspending walls 32 are restored inward owing to the elasticity, so that the upper end section of the screen installation frame 1 is inserted into the upper guide frame 3. Additionally, it is preferable to form contact surfaces of the fall-down prevention guide section 11 and the guide rail projection 31 into a curved surface such as an arch, as shown in FIG. 5, in order to facilitate the opening of the suspending wall 32 outward.

Figure 6:
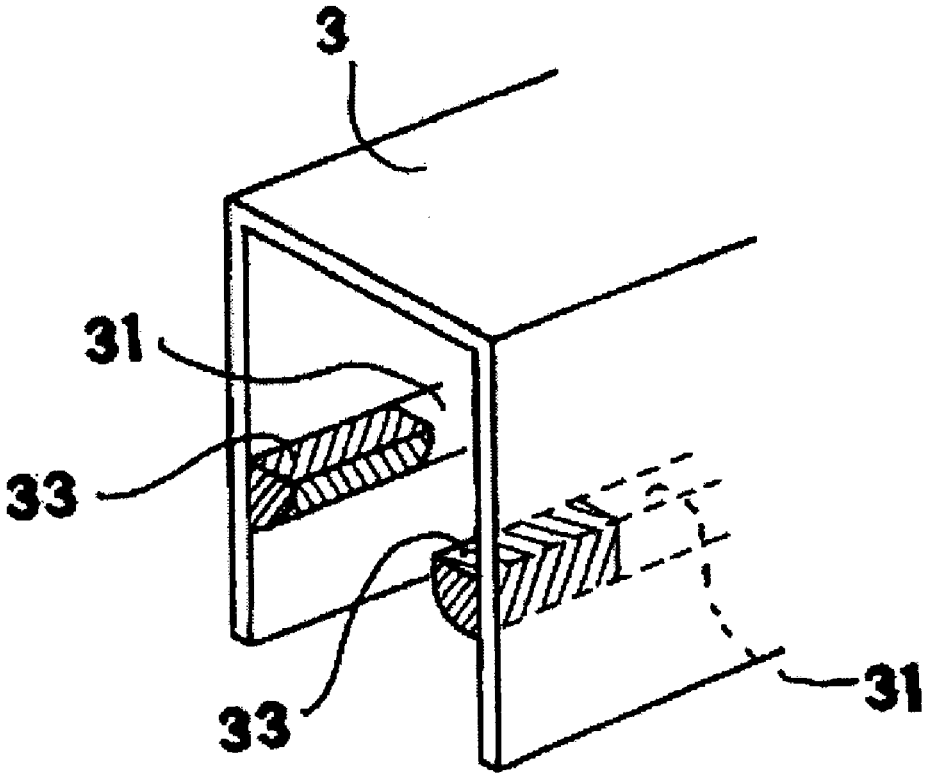
FIG. 6 is a perspective view showing essential parts of the upper guide frame in another form.

In a screen device shown in FIG. 6, in order to facilitate work for inserting the upper end section of the screen installation frame 1 into the upper guide frame 3, a part of the guide rail projection 31 is cut out, so that the upper end section of the screen installation frame 1 provided with the fall-down prevention guide section 11 can be inserted into the upper guide frame 3 through a cutout 33.

Figure 7:
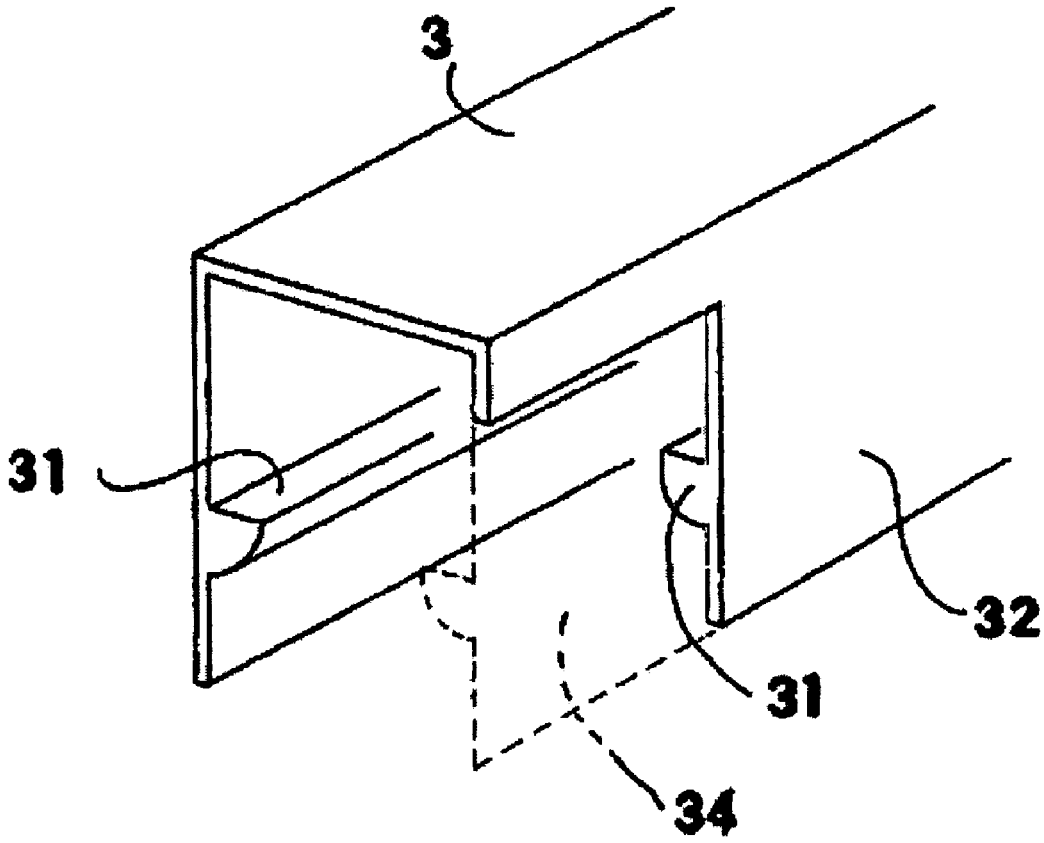
FIG. 7 is a perspective view showing essential parts of the upper guide frame in another form.

In a screen device shown in FIG. 7, a part of the suspending wall 32 of the upper guide frame 3 is cut out, so that the upper end section of the screen installation frame 1 provided with the fall-down prevention guide section 11 can be readily inserted into the upper guide frame 3 through a cutout 34.

Figure 8:
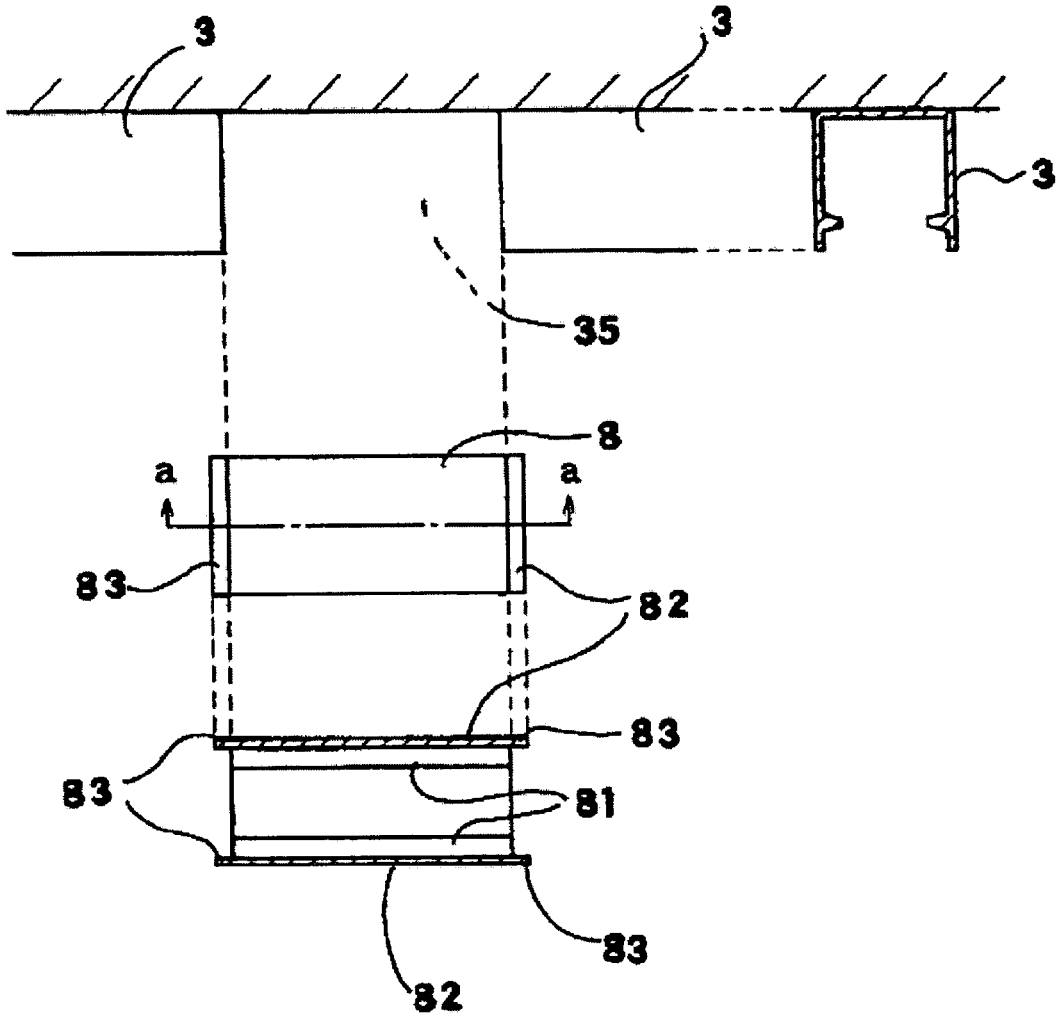
FIG. 8 is a schematic view showing the upper guide frame in another form and a cap member.

In a screen device shown in FIG. 8, the upper guide frame 3 is positioned with a clearance 35. The clearance 35 may be formed along the upper guide frame 3 or between the upper guide frame 3 and the wall surface or a vertical crosspiece. Additionally, in the screen device shown in FIG. 8, the upper end section of the screen installation frame 1 provided with the fall-down prevention guide section 11 can be readily inserted into the upper guide frame 3 through the clearance 35.

Figure 9:
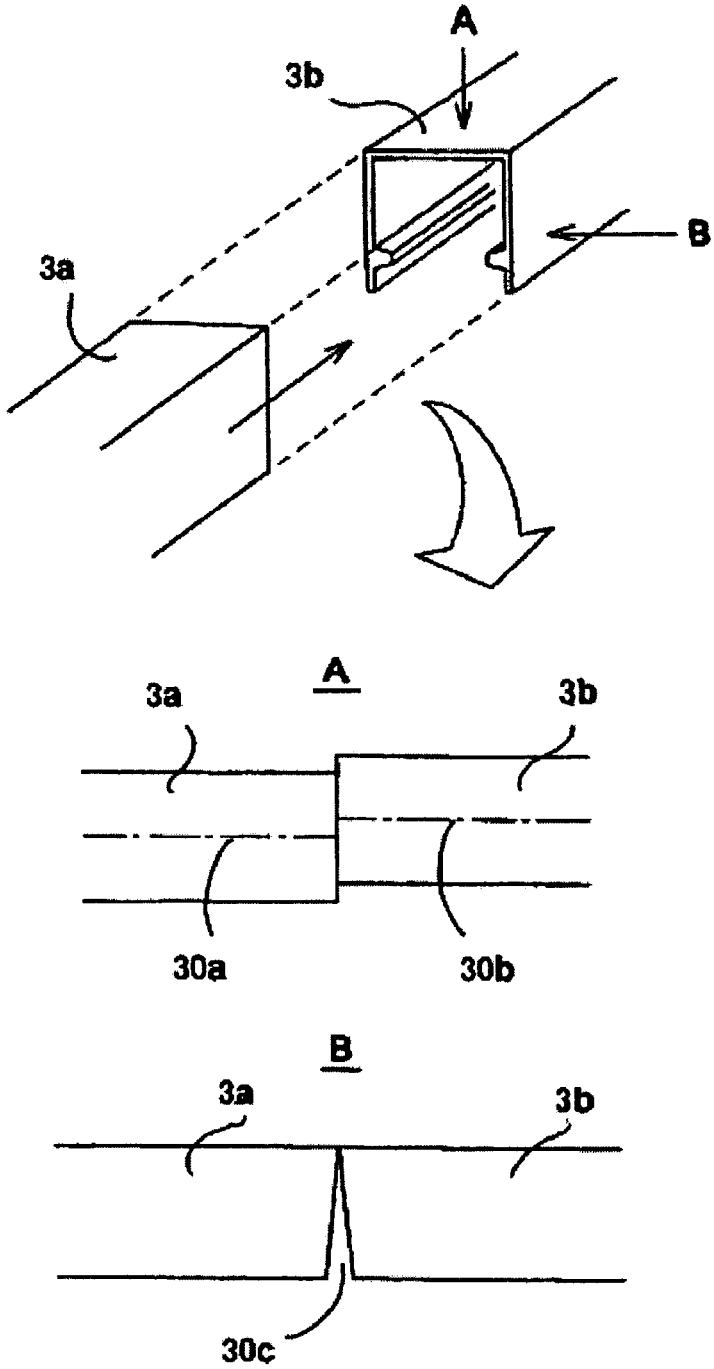
FIG. 9 is a schematic view explanatory of a problem which may be caused by connection of the upper guide frame when there is no clearance.

Here, the clearance 35 is effective in inserting the upper end section of the screen installation frame 1 into the upper guide frame 3 and suitable for installation of the screen device in a large space. In installing the screen device in a large space, the upper guide frame 3 is required to be long. However, it is preferable to connect frames divided into a plurality of pieces to each other in consideration of workability and transportability. In this case, from the perspective of ensuring a smooth and stable sliding motion and the appropriate design of an exterior appearance of the screen installation frame 1, work needs to be carried out with an accuracy high enough to prevent any misalignment between axes 30*a* and 30*b* in a longitudinal direction and to prevent any generation of a gap 30*c* at an end face when respective ends of divided upper guide frames 3*a* and 3*b* are mated with each other, as shown in FIG. 9. Actually, it is not easy to perform the work at a site with such high accuracy.

In view of this, as with the screen device shown in FIG. 8, a relatively large clearance 35 is formed at the upper guide frame 3. Even if the axes 30*a* and 30*b* are misaligned or the gap 30*c* is generated at the end face, little force is imparted on the sliding motion of the screen installation frame 1 due to the relatively large clearance 35, with the attendant advantage of visual unobtrusiveness. From the viewpoints of a smoother and more stable sliding motion and the design of the screen installation frame 1, it is effective that the plurality of clearances 35 are formed and a cap member 8 shown in FIG. 8 is attached to each of the clearances 35.

Figure 10:
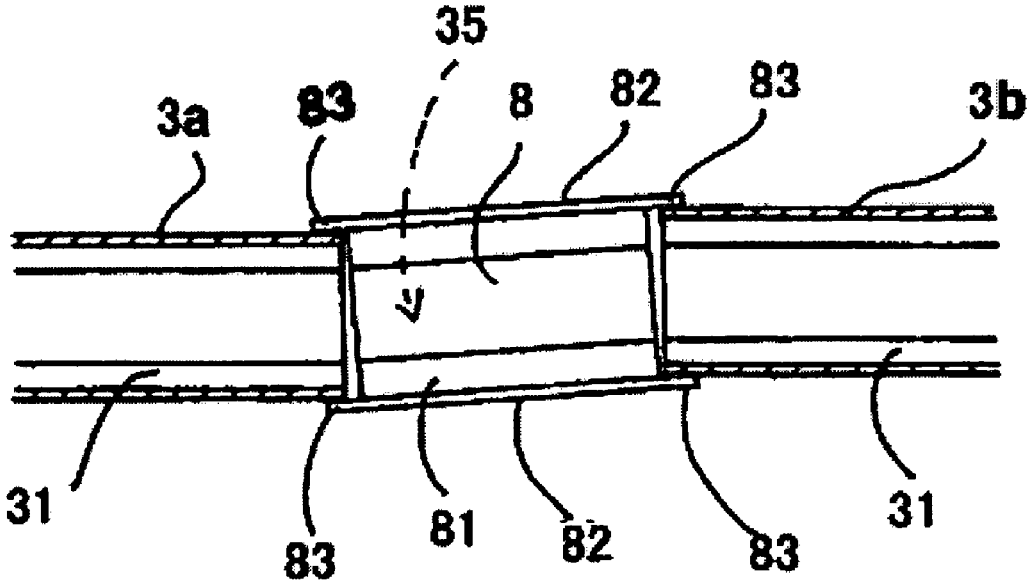
FIG. 10 is a bottom view showing essential parts of the connection of the upper guide frame by the cap member.

The cap member 8 includes a suspending wall 82, inside of which a guide rail projection 81 is disposed. Like the upper guide frame 3, the cap member 8 can prevent the screen installation frame 1, which slides, from being detached and falling down or being inclined. At both side ends of the suspending wall 82 are tongue pieces 83 overlapping the end surface of the upper guide frame 3. As illustrated in FIG. 10, the cap member 8 is securely disposed at the clearance 35 by the effect of the tongue piece 83. Thus, the screen installation frame 1 can slide smoothly and stably by the guide function of the cap member 8 even if the axes of the upper guide frames 3*a* and 3*b* are misaligned.

Figure 11:
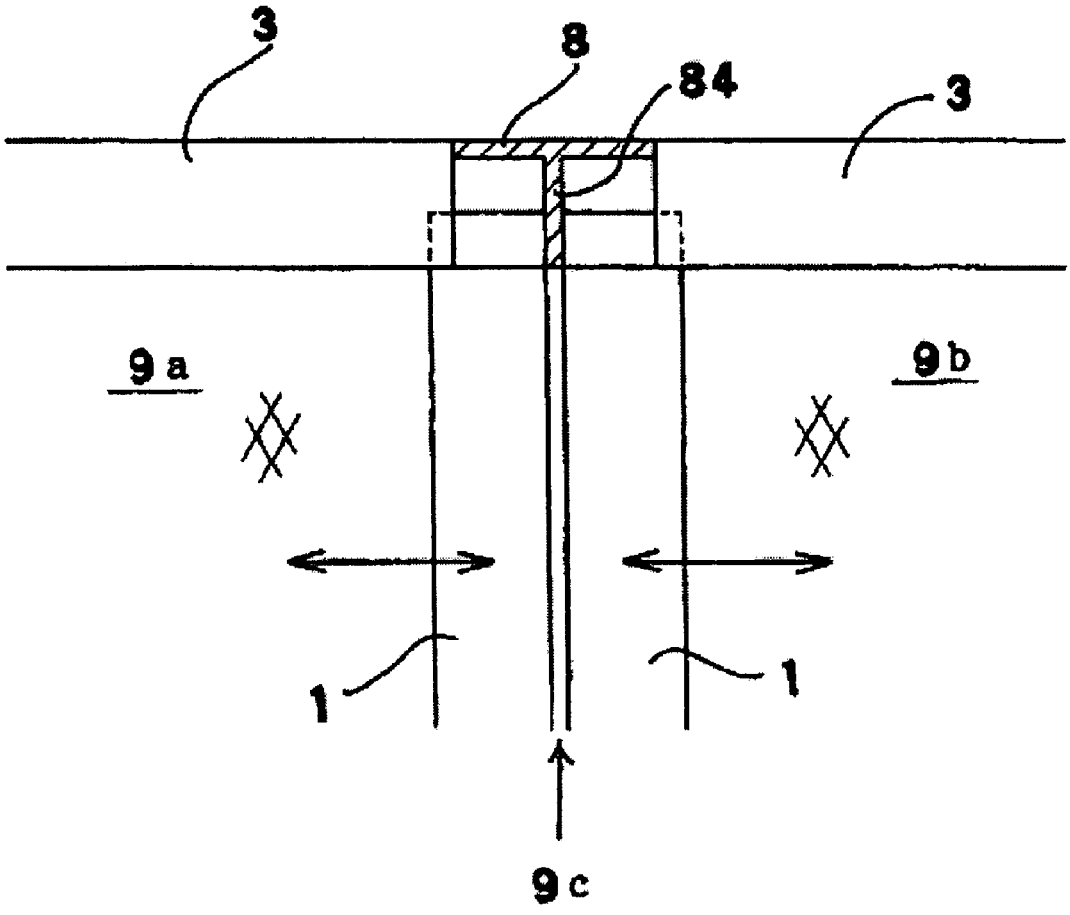
FIG. 11 is a broken front view showing the outline of an example, in which a stopper is positioned in the cap member.
Figure 12:
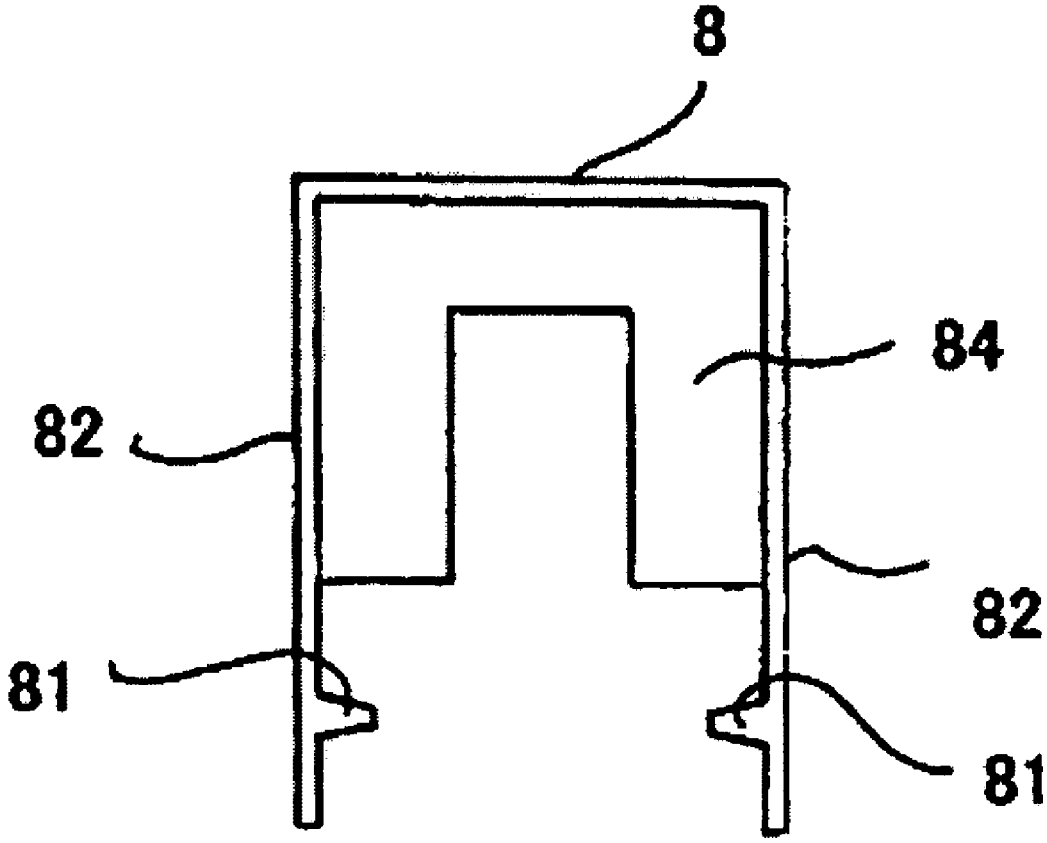
FIG. 12 is a side view showing the cap member having the stopper positioned therein.

The cap member 8 is located at a mating position 9*c* of separation type screen devices 9*a* and 9*b*, as shown in FIGS. 11 and 12. In this case, it is effective that a stopper 84 is positioned at the mating position 9*c* inside the cap member 8.

The stopper 84 enables the slidable screen installation frame 1 to be stopped at the predetermined mating position 9*c* in the separation type screen devices 9*a* and 9*b*. The stoppage of the screen installation frame 1 at the mating position 9*c* can prevent in advance any inconvenience from occurring at the screen 2 due to a load in association with the sliding motion of the screen device, that is, an excessive opening/closing distance or the like.

The screen device according to the invention may be configured such that both of a pair of screen installation frames 1, each having the screen attached thereto, can slide, and that at least either one of the screen installation frames 1 is connected to the slidable screen installation frame 1 in another screen device via a connector. Such a construction type screen device is configured such that a plurality of unified screen devices a, b and c are connected to each other via respective connectors 10 of screen installation frames 1 arranged adjacently to each other, in a contracted state shown in FIGS. 13A and 13B and in an expanded state shown in FIG. 14.

Figure 13:
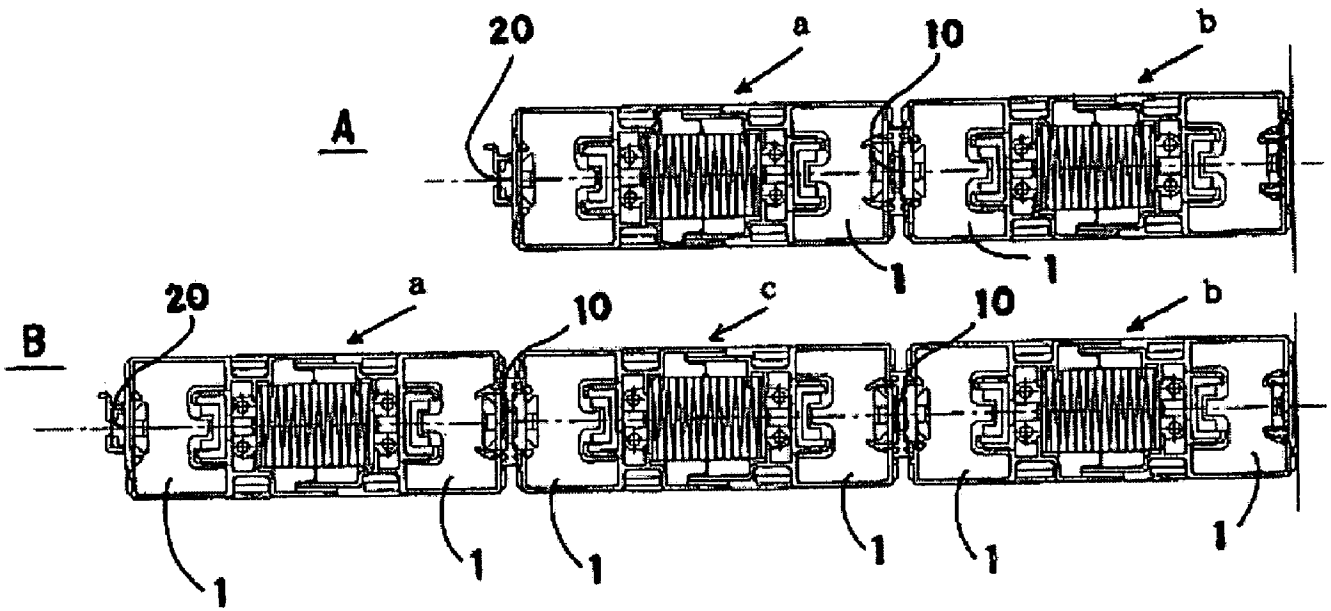
FIG. 13 is a horizontal cross-sectional view showing a contracted state of a one-way drawing type screen device constituted by connecting unified screen devices to each other.
Figure 14:
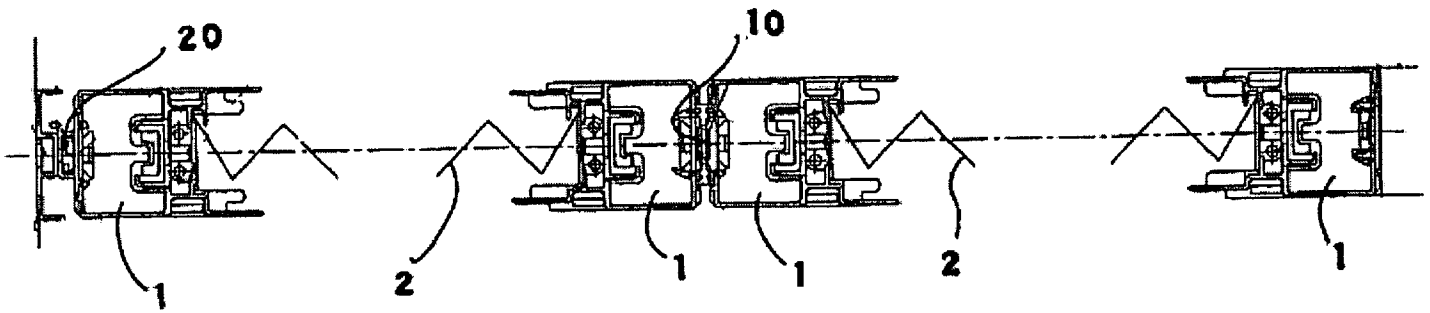
FIG. 14 is a horizontal cross-sectional view showing the screen device shown in FIG. 13 in an expanded state.
Figure 15:
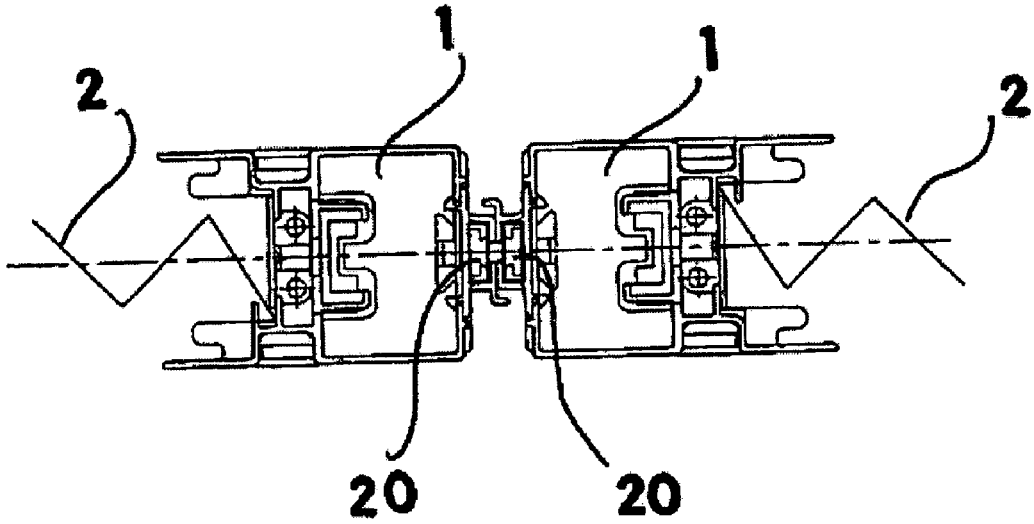
FIG. 15 is a horizontal cross-sectional view showing essential parts of a double-leaf drawing type screen device.
Figure 16:
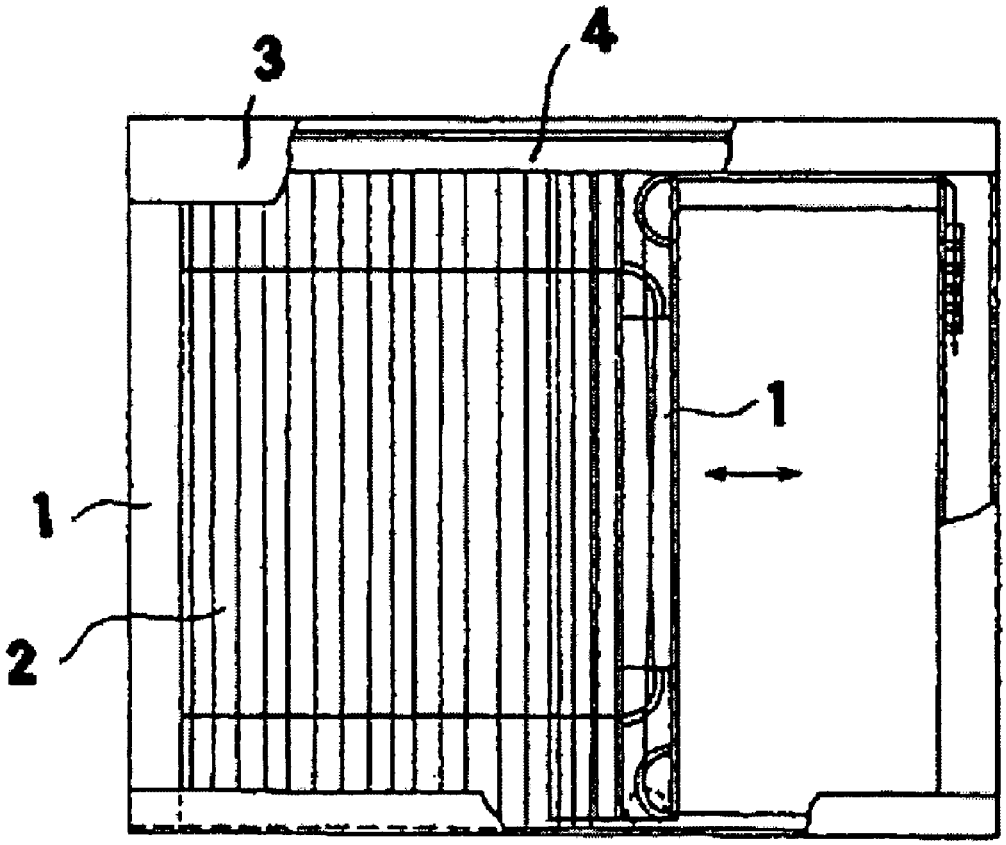
FIG. 16 is a broken front view showing a screen device which has been developed and put into practical use by the present applicant.
Figure 17:
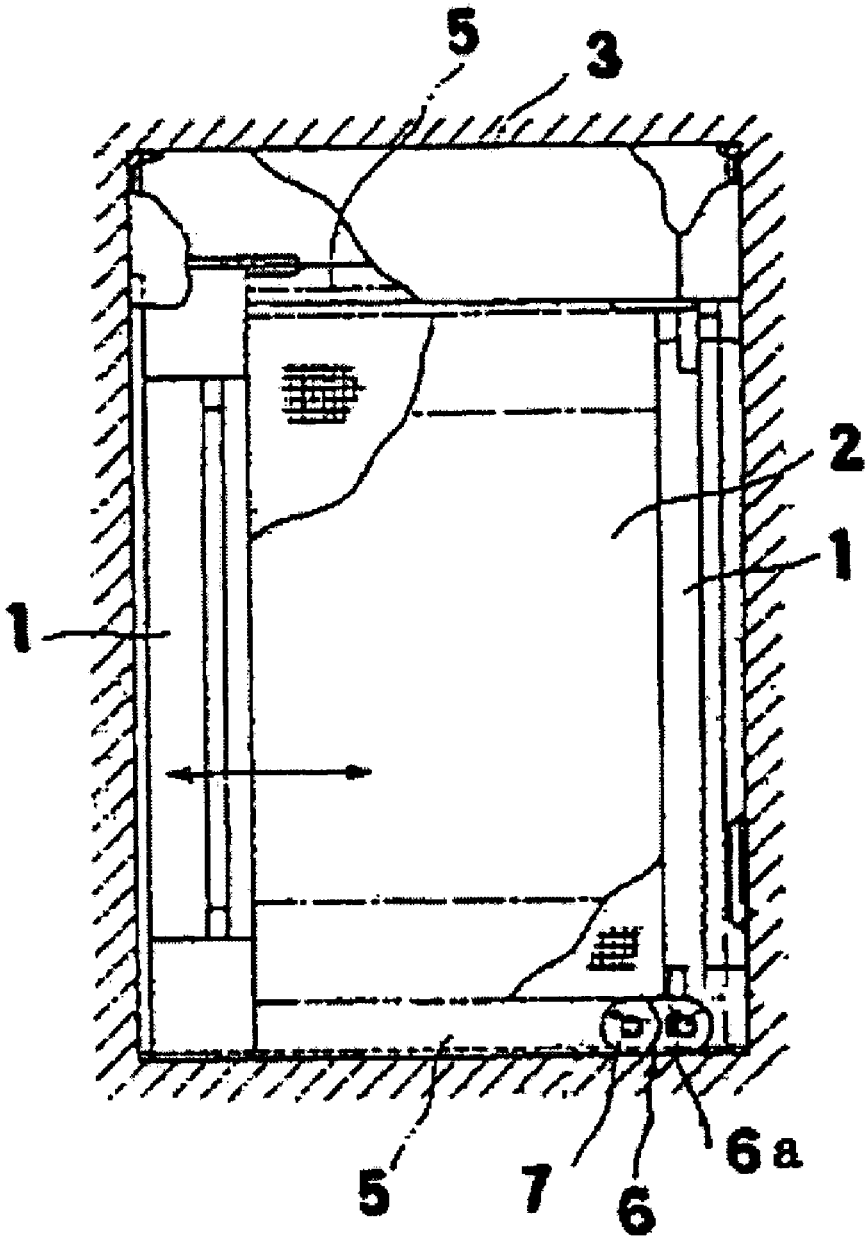
FIG. 17 is a broken front view showing another screen device that has been developed and put into practical use by the present applicant.
Figure 18:
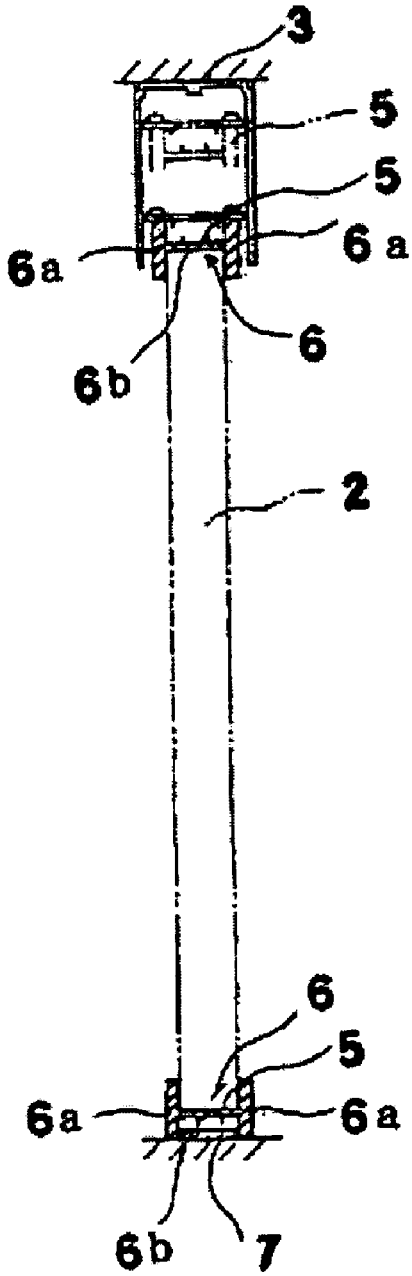
FIG. 18 is a side cross-sectional view showing the screen device shown in FIG. 17.

The screen device can be implemented by the one-way drawing type screen device shown in FIGS. 13 and 14 or a double-leaf drawing type screen device shown in FIG. 15. Reference numeral 20 denotes a magnet for fixing the screen installation frames 1 to each other.

In any one of the screen devices, the screen installation frame 1 can be prevented from being detached from the upper guide frame 3. Furthermore, the upper end section of the screen installation frame 1 can be readily inserted into the upper guide frame 3 even in a large-sized screen device.

Additionally, although the screen 2 is typified by a foldable and unfoldable pleat net member in the screen device according to the invention, the screen 2 is not limited to a pleat net member, but it may be a pleat member made of cloth or a sheet. Otherwise, the screen device may incorporate therein a rotary roll that can be freely wound or pulled.

In the screen device, the upper end section of the screen installation frame can be prevented from being detached from the upper guide frame, and further, the upper end section of the screen installation frame is readily inserted into the upper guide frame even in a large-sized screen device.

The invention claimed is:

1. A screen device comprising:

a first screen installation frame;

a second screen installation frame moveable between an opened state and a closed state, said second screen installation frame including an upper end section;

a screen disposed between said first screen installation frame and said second screen installation frame; and a first upper guide frame including a guide rail projection;

wherein said second screen installation frame includes a fall-down prevention guide section formed as a projection or a groove at said upper end section, said fall-down prevention guide section being disposed in said first upper guide frame, wherein said fall-down prevention guide section is disposed above said guide rail projection with a clearance between said fall-down prevention guide section and said guide rail when said second screen installation frame is in a normal state, wherein said fall-down prevention guide section is integrally included with said upper end section of said second screen installation frame, and wherein said fall-down prevention guide section is operable to contact said guide rail projection when the second screen installation frame is inclined away from said normal state so as to prevent said second screen installation frame from being detached from said first upper guide frame, wherein said second screen installation frame is supported such that said fall-down prevention guide section does not contact said guide rail projection unless said second screen installation frame is inclined away from said normal state, and such that said clearance is eliminated when said fall-down prevention guide section contacts said guide rail projection.

2. The screen device of claim 1, further comprising:

a supporting rail provided below said second screen installation frame for supporting a bottom end section of said second screen installation frame;

wherein a length of said second screen installation frame is longer than a distance from said supporting rail to said guide rail projection such that said clearance is maintained when second screen installation frame is in said normal state.

3. The screen device of claim 1, wherein said first upper guide frame comprises a first suspended wall and a second suspended wall opposed to said first suspended wall, at least one of said first suspended wall and said second suspended wall being elastically deformable such that said first upper guide frame is operable to deform around said fall-down prevention section when said second screen installation frame is inserted into said first upper guide frame.

4. The screen device of claim 1, wherein said guide rail projection includes a cut-out portion for insertion of said upper end section of said second screen installation frame into said first upper guide frame.

5. The screen device of claim 1, wherein said first upper guide frame comprises a first suspended wall and a second suspended wall opposed to said first suspended wall, said first suspending wall including a cut-out portion for insertion of said upper end section of said second screen installation frame into said first upper guide frame.

6. The screen device of claim 1, further comprising:

a second upper guide frame member spaced apart from said first upper guide frame member such that a gap is provided between said first upper guide frame member and said second upper guide frame member;

wherein a length of said gap is such that said second screen installation frame is insertable through said gap into at least one of said first upper guide frame member and said second upper guide frame member.

7. The screen device of claim 6, further comprising:

a cap member provided for attaching said first upper guide frame member to said second upper guide frame member and bridging said gap.

8. The screen device of claim 7, further comprising a third screen installation frame moveable between an opened state and a closed state, said second upper guide frame covering an upper end section of said third screen installation frame and guiding said third screen installation frame;

wherein said cap member is provided at a mating position of said first upper guide frame and said second upper guide frame, and wherein said cap member includes a stopper for stopping a movement of at least one of said second screen installation frame and said third screen installation frame.

9. The screen device of claim 1, wherein said first screen installation frame is moveable between an opened state and a closed state, wherein said screen is attached to each of said first screen installation frame and said second screen installation frame, and wherein a connector is provided for attaching at least one of said first screen installation frame and said second screen installation frame to another screen device.

10. The screen device of claim 1, wherein the screen includes a foldable and unfoldable pleated net member.

* * * * *